US006223711B1

(12) United States Patent
Pelz

(10) Patent No.: US 6,223,711 B1
(45) Date of Patent: May 1, 2001

(54) PISTON, ESPECIALLY FOR AN INTERNAL COMBUSTION ENGINE WITH DOUBLE CRANK DRIVE

(76) Inventor: Peter Pelz, Daimlerweg 2, D-82538 Geretsried (DE)

( * ) Notice: Subject to any disclaimer, the term of this patent is extended or adjusted under 35 U.S.C. 154(b) by 0 days.

(21) Appl. No.: 09/388,082

(22) Filed: Aug. 27, 1999

(30) Foreign Application Priority Data

Aug. 28, 1998 (DE) ..... 198 39 226

(51) Int. Cl.[7] ..... F02F 75/06
(52) U.S. Cl. ..... 123/193.6
(58) Field of Search ..... 123/193.6; 92/113, 92/107

(56) References Cited

U.S. PATENT DOCUMENTS 3,848,518 * 11/1974 Martin ..... 92/107
5,014,599 * 5/1991 Kocsis et al. ..... 92/113
5,029,562 * 7/1991 Kamo ..... 123/193.6
5,317,958 * 6/1994 Martins Leites et al. ..... 123/193.6
5,778,846 * 7/1998 Mielke ..... 123/193.6
5,947,065 * 9/1999 Bing et al. ..... 123/193.6

FOREIGN PATENT DOCUMENTS 32 38 030 A1 4/1983 (DE) .

* cited by examiner

*Primary Examiner*—Marguerite McMahon
(74) *Attorney, Agent, or Firm*—Robert W. Becker & Associates

(57) ABSTRACT

A piston for an internal combustion engine has a piston body with a bottom. The piston body has at least two shaped sheet metal parts having monolithic flaps bent out of a radial plane of the piston body. The flaps are positioned at the bottom of the piston body. The flaps have eyes for at least one connecting rod. The piston is preferably designed without a skirt. Instead of the flaps, it is also possible to provide the bottom of the piston with a projection that is conical and tapers in a direction away from the bottom. The connecting rod is then connected to this projection.

10 Claims, 3 Drawing Sheets

PISTON, ESPECIALLY FOR AN INTERNAL COMBUSTION ENGINE WITH DOUBLE CRANK DRIVE

BACKGROUND OF THE INVENTION

The present invention relates to a piston, especially for an internal combustion engine, with double crank drive.

An internal combustion engine with double crank drive is, for example, known from German patent application 32 38 030 A1. For such a double crank drive each piston is connected with at least one connecting rod to one of the two crank shafts which rotate at the same rpm in opposite directions and are connected to one another by a toothing. An advantage of such a double crank drive is that the piston runs without lateral forces in the cylinder and that the force of the piston is transmitted by at least two connecting rods onto the crankshafts so that the weight of the connecting rods can be reduced and a higher rpm stability can be achieved. Furthermore, with a proper selection of the slanted position of the connecting rod at the top dead center and bottom dead center of the piston the movement kinematics of the piston relative to the rotation of the crankshaft can be designed different from a sine-shaped movement so that the thermodynamic conditions and thus the output development and the torque can be favorably affected.

In general, high requirements are placed on pistons which have a bottom conventionally delimiting the combustion chamber or, in the case of pumps, the working chamber, wherein the bottom has a transition into a mantle at its outer circumference which mantle extends parallel to the cylinder wall. The pistons must be sufficiently resistant to the effects of heat in order to withstand the peak pressures during combustion and the high acceleration and deceleration forces. Furthermore, the pistons should be lightweight so that high masses are not moved unnecessarily in a reciprocating manner.

It is therefore an object of the present invention to provide a piston which has a sufficient stability especially in connection with minimal weight and a simple manufacturing process.

SUMMARY OF THE INVENTION

A first solution of this inventive object is realized in that the piston is comprised of at least two shaped sheet metal parts having integral flaps that are bent out of the plane of the sheet metal parts and support at least one connecting rod. This provides an inexpensive very lightweight piston which can be adapted in multiple ways to the respective requirements. Expediently, two of the flaps, which are provided at different shaped sheet metal parts, are combined to serve as a common bearing means or attachment location for the connecting rod. In a preferred embodiment, two shaped sheet metal parts are provided which extend over the entire surface area of the piston bottom. At least one bendable flap is stamped out of each of the shaped sheet metal parts, whereby the flaps are arranged such that the flap of one of the sheet metal parts penetrates through the opening resulting from bending the flap out of the plane of the other sheet metal part. The two flaps are then connected to one another.

In another embodiment, multiple flaps are arranged at the bottom of the piston for supporting a plurality of connecting rods in order to provide a uniform loading of the piston.

Preferably, at least one shaped sheet metal part is bent at its outer circumference in order to form a groove for receiving a piston ring.

Another object of the invention is solved by providing a conically shaped tapered projection of a shaped sheet metal part which forms at least a portion of the bottom of the piston and ends in an area for connecting the piston rod.

In this design of a multi-component piston the connecting rod or piston rod is not connected to one or more flaps bent out of the plane of the shaped sheet metal parts but is provided in the form of a conical tapered projection of a shaped sheet metal part that forms at least one portion of the bottom of the piston.

Expediently, the piston is manufactured without a skirt. Such a skirtless piston, which is advantageously useful for pumps or internal combustion engine in which the piston is linearly guided, is extremely lightweight and therefore suitable for high rpm.

In yet another embodiment of the invention, the piston at its circumference is provided with an annular disk that in a direction toward the combustion chamber is curved and is embodied of an elastic material. Upon pressure loading from the combustion chamber it flattens out under enlargement of its outer diameter. This piston is not provided with an individual piston ring for sealing between cylinder wall and outer circumference of the piston. This function is provided by the annular disk facing the combustion chamber which is flattened by the pressure within the combustion chamber so that its diameter will increase and will seal the piston and cylinder walls relative to one another.

Preferably, the piston at the end face facing the combustion chamber is provided with a thermal insulation coating.

BRIEF DESCRIPTION OF THE DRAWINGS

The object and advantages of the present invention will appear more clearly from the following specification in conjunction with the accompanying drawings, in which.

DESCRIPTION OF THE PREFERRED EMBODIMENTS

The present invention will now be described in detail with the aid of several specific embodiments utilizing FIGS. 1 through 8.

Figure 1:
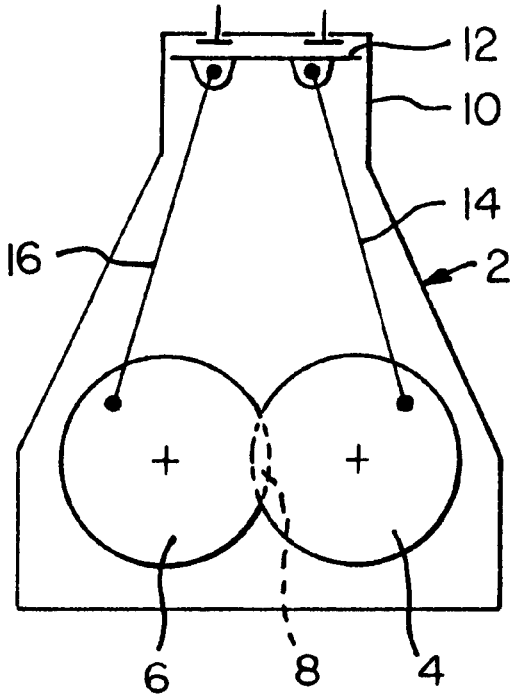
FIG. 1 shows a schematic view of an internal combustion engine with double crank drive.

According to FIG. 1 an internal combustion engine has a housing 2 in which two crankshafts 4, 6 are rotatably supported. The crankshafts 4, 6 are engaged by toothings 8 with one another so that they rotate in opposite directions with identical rpm. A piston 12 is moveable in the cylinder 10 and is connected to each one of the crankshafts 4 and 6 by a respective connecting rod 14 and 16.

The piston 12 is guided in this manner linearly in the cylinder 10 so that it is moveable therein without lateral forces acting on it. When the connecting points of the connecting rods 14, 16 at the piston 12 are not arranged coaxially to one another but, as represented, have a spacing to one another, the piston 12 is also prevented from tilting.

Figure 2:
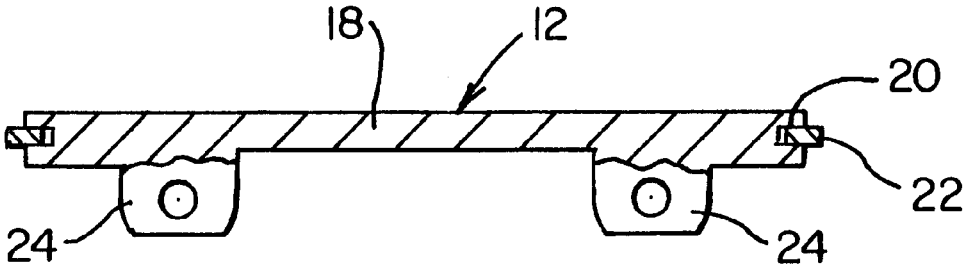
FIG. 2 shows in section a piston to be used in connection with the engine of FIG. 1.

FIG. 2 shows an advantageous embodiment of a piston 12. The piston 12 is comprised of a plate-shaped bottom 18 having at its outer circumference an annular groove 20 in which a piston ring 22 is arranged. For supporting the connecting rods 14, 16, the bottom 18 is provided with projections 24 which have a hole for receiving, for example, a connecting rod bolt.

The piston 12 is extremely lightweight because it is designed without a skirt so that it is suitable for high rpm. It may be embodied as a unitary cast part or can be comprised of multiple parts which will be explained in the following example. The piston ring 22 can be eliminated when a suitable material is selected for the piston. On the other hand, a plurality of piston rings 22 may be provided. Depending on the design of the double crank drive and of the connecting rods (for example, two connecting rods 14 and 16 each at opposed sides of the double disks of the crankshafts), a plurality of projections 24 may be provided which advantageously are distributed such that a surface loading that is as uniform as possible is provided at the piston 12. For crank drives which comprise only a linearly reciprocating piston rod actuated by slide blocks or a single double crank drive, only one projection 24 must be provided centrally at the piston 12.

Figure 3:
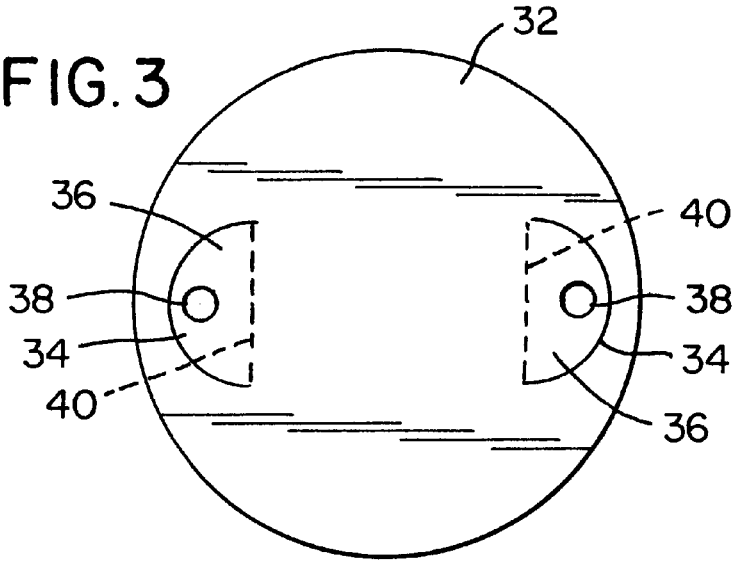
FIG. 3 shows a view onto a first shaped sheet metal part.
Figure 4:
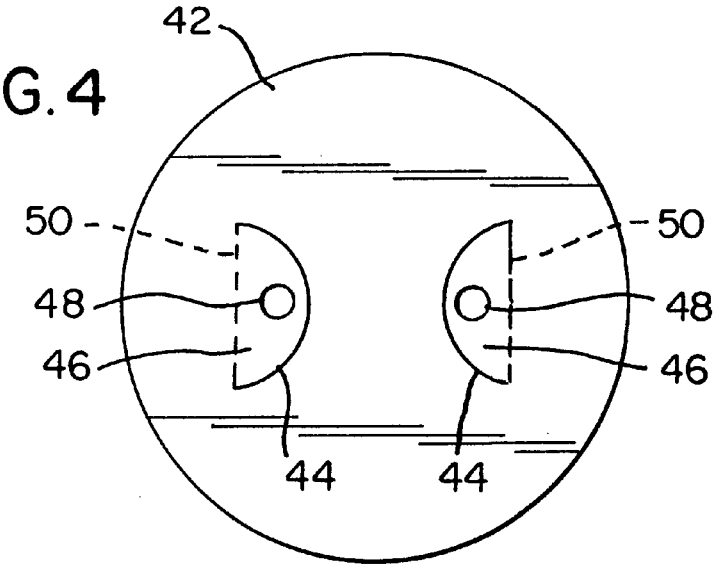
FIG. 4 shows a view onto a second shaped sheet metal part.
Figure 5:
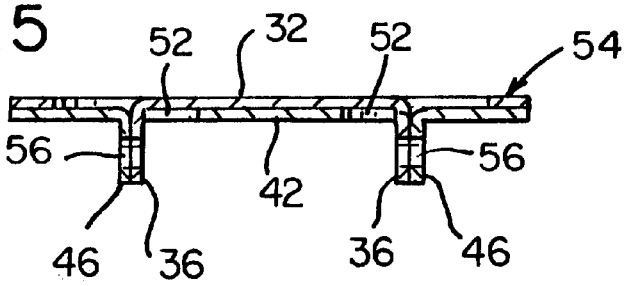
FIG. 5 shows a cross-sectional view of a piston comprised of the two sheet metal parts according to FIGS. 3 and 4.

With the aid of FIGS. 3 through 5, a further embodiment of a piston is disclosed which is comprised of a plurality of shaped sheet metal parts.

According to FIG. 3, at the circumference of a piston to be produced the respective shaped sheet metal part 32 has a circular plate design which has two stamping lines 34 that are substantially semi-circular. The flaps 36 which are formed along the semi-circular stamping lines 34 are also provided with stamped holes 38. The flaps 36 can be bent out of the plane of the sheet metal part along the bending line 40 to project from the plane of the shaped sheet metal part 32.

FIG. 4 shows a further sheet metal part 42 with stamping lines 44, flaps 46, holes 48, and bending lines 50. Part 42 differs from the sheet metal part 32 only in that the flaps 46, respectively, stamping lines 44 are within the bending lines 50.

According to FIG. 5, the flaps 36, 46 and bending lines 40, 50 of the two sheet metal parts 32 and 42 are designed such that after bending of the flaps 36 and 46, the flaps 36 of the shaped sheet metal part 32 can be placed into the cutouts 52 which are the result of the flaps 46 being bent out of the shaped sheet metal part 42. Furthermore, the bending lines 40 and 50 are arranged such that the two flaps 36 and 46 will come into direct contact with one another and such that the holes 38 and 48 will be aligned with one another to form a bearing means so that the piston 54 comprised of the two sheet metal parts 32 and 42 has eyes 56 which are formed by the flaps 36 and 46 with the respective holes 38 and 48. A respective connecting rod can be connected to each one of the eyes 56 or a single connecting rod can be mounted by a suitable bolt to both eyes 56.

The flaps 36 and 46 can be connected to one another, like the remaining portions of the shaped sheet metal parts 32 and 42, by welding, by use of an adhesive, or other connecting means.

The piston 54, as can be taken from the above description, can be produced with simple tools, whereby a piston results that because of its laminary structure is very stable but lightweight and wherein the two eyes 56 provide for an excellent distribution of the mechanical loading over the entire piston surface. It is understood that each shaped sheet metal part can be provided with only one or more than two flaps so that the piston can be adapted to the respective requirements, especially with respect to the force introduction from the connecting rod or the connecting rods into the piston or piston bottom being uniform. This allows to realize a more lightweight piston.

The cutouts or openings produced in the upper sheet metal part 32 by bending the flaps 36 out of the plane can be welded together at their edges or can be filled with suitable materials so that the piston is reliably sealed. Furthermore, the entire piston can be provided with a ceramic coating which is anchored in the cutouts or openings resulting from bending of the flaps 36.

Figure 6:
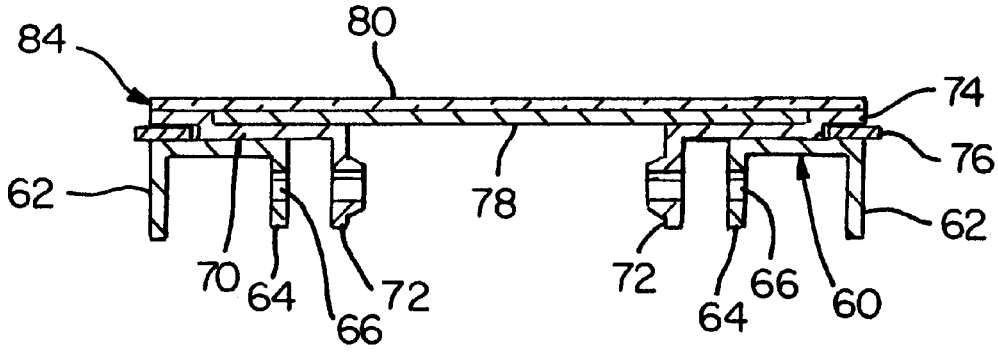
FIGS. 6 show cross-sections of further embodiments of through 8 the inventive piston.

FIG. 6 shows another embodiment of a piston. The first sheet metal part 60 is bent to form a ring with a substantially U-shaped cross-section whereby the outer leg of the U forms a skirt 62 and the inner leg 64 having a length that differs from that of the skirt 62, is provided with holes 66 for connecting one or more connecting rods thereto. The shaped sheet metal part 60 can be produced from a circular sheet metal disk by stamping and bending.

A further sheet metal part 70 is connected to the first sheet metal part 60 and has a sheet metal ring which is bent to form an inner leg 72 and is bent at its outer circumference such that a groove 74 for receiving a piston ring 76 is provided. A further sheet metal part 78 embodied as a disk is provided at the sheet metal part 70 which covers the area between the circumferential groove 74 provided at the sheet metal part 70. The sheet metal parts 60, 70 and 78 can be connected to one another by welding, by use of an adhesive, or any other suitable connecting means.

The inner legs 64 and 72 of the shaped sheet metal parts 60 and 70 are provided with holes so that bearing means or eyes for fastening the connecting rods are provided. The inner legs 64 and 72 must not be of a circumferential design but can be embodied by bent portions provided with holes for connecting the connecting rods thereto. The holes can be punched through or provided with projections, as shown in FIG. 6 for the holes of the inner leg 72, so that the bearing action of a connecting rod bolt or pin is stabilized.

In the shown embodiment, the sheet metal part 78 and the planar outer area of the sheet metal part 70 is provided with a high-temperature resistant layer (coating) 80 which can be sprayed, sintered or otherwise connected to the sheet metal parts so that the sheet metal parts 78 and 70 of the piston 84 will not come into direct contact with the gases in the combustion chamber of the internal combustion engine.

In an altered embodiment of the piston of FIG. 6, the groove 74 with the piston ring 76 can be eliminated and the ceramic layer 80 can extend radially past the skirt 62 so that the ceramic layer 80 will take over the function of a piston ring.

Figure 7:
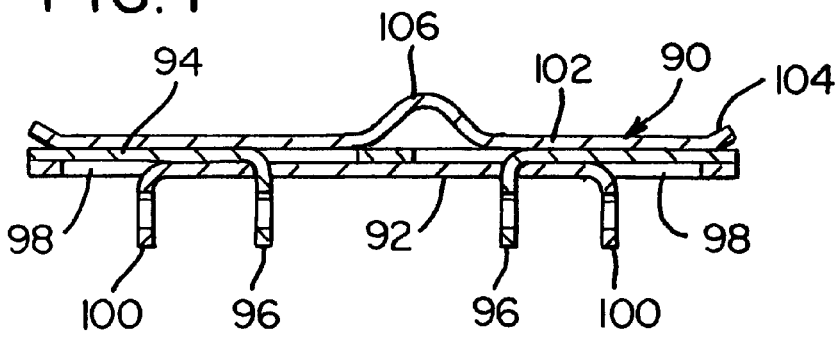

FIG. 7 shows a further embodiment of the piston 90 which is comprised of three sheet metal parts. The lower two sheet metal parts 92 and 94 correspond in a certain fashion to the sheet metal parts 32 and 42 of the embodiment according to FIG. 5 whereby the flaps 96 bent out of the plane of the upper sheet metal part 94 are inserted into cutouts or openings 98 of the lower sheet metal part 92 which do not result from the bending of the flaps 100 of the lower sheet metal part 92 but are separately formed slots of the lower sheet metal part 92. Above the upper sheet metal part 94 a further sheet metal disk 102 is arranged which has an upwardly curved edge portion 104 which is not connected with the lower sheet metal part 94. The material thickness or elasticity of the edge portion 104 and its radial extension are selected such that the edge portion, when subjected to pressure from above, will be flattened as shown in FIG. 7 so that the outer diameter of the edge portion 104 will slightly increase and the flattened edge portion will then project radially past the sheet metal part 94 and will act in the manner of a piston ring to provide a sealing action between the piston 90 and the cylinder wall not shown in FIG. 7.

The sheet metal disk 102 is provided with a projection 106 so that with a corresponding design of the sheet metal disk 102 bulges projecting into the combustion chamber are provided which are advantageous with regard to thermodynamic requirements of the load combustion in the internal combustion chamber.

Figure 8:
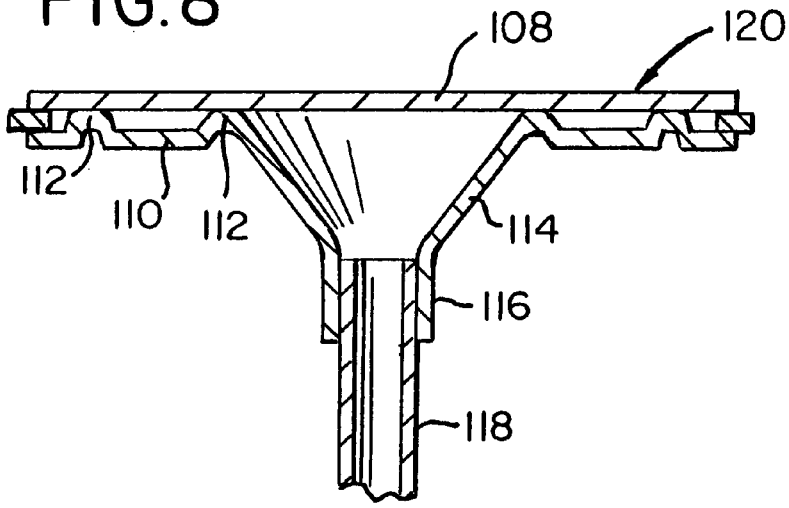

FIG. 8 shows piston 120 comprised of two sheet metal parts 108 and 110. The upper sheet metal part 108 is a flat disk. The lower sheet metal part 110 is designed such that it has circumferential ribs 112 which are stiffly connected to the sheet metal part 108 and, in its central area, is provided with a conical tapering projection 114 projecting downwardly away from the central area, whereby the projection 114 has an area 116 that is to be connected with the piston rod 118. The piston rod 118 can be connected rigidly with the area 116 so that the area 116 then advantageously is designed to be cylindrical. The piston rod 118 can also be connected in the manner of a connecting rod to the projection 116 whereby the projection 116 then has two lateral flaps so that a non-represented bearing bolt can be inserted.

It is understood that multiple variations of the disclosed embodiments are possible. The flaps for connecting the one or more connecting rods can be distributed across the pistons so that a loading action as uniform as possible is reached. The materials of the individual layers or sheet metal parts can be selected as desired so that, depending on the intended use, an excellent thermal insulation, excellent heat conducting properties, minimal heat capacity toward the combustion chamber etc. can be achieved. The uppermost layer, facing the combustion chamber, can be highly polished which reduces heat uptake of the piston, increases its heat reflection properties, and counteracts the formation of deposits. In an alternative, the uppermost layer can also be porous or can be catalytically active.

Depending on the desired design, a skirt may be provided. The flaps which are formed in the individual sheet metal parts can be in direct contact with one another or can be spaced from one another.

The disclosed piston is suitable not only for use in internal combustion engines, especially internal combustion engines with double crank drive, but also in pumps, hydraulic and pneumatic cylinders etc.

The specification incorporates by reference the disclosure of German priority document 198 39 226.5 of Aug. 28, 1998.

The present invention is, of course, in no way restricted to the specific disclosure of the specification and drawings, but also encompasses any modifications within the scope of the appended claims.

What is claimed is:

1. A piston for an internal combustion engine, said piston comprising:

a piston body having a bottom and composed of at least two sheet metal parts, at least one of which extends over an entire width of said piston to form said piston bottom.

2. A piston according to claim 1, wherein said piston body has a circumferential annular ring curved away from said piston body in a direction toward a combustion chamber, wherein said annular ring is comprised of an elastic material, and wherein said annular ring flattens to increase an outer diameter thereof when pressure-loaded by pressure in the combustion chamber.

3. A piston according to claim 1, wherein at least one monolithic flap is bent out of at least one of said sheet metal parts, wherein said at least one flap is adapted to receive at least one connecting rod.

4. A piston according to claim 1, wherein one of said sheet metal parts forms at least a part of said piston bottom and is provided with a conically tapered projection that has an end portion for connection to a piston rod.

5. A piston according to claim 1, wherein said piston has no skirt.

6. A piston according to claim 1, wherein a first one of said flaps (36), belonging to a first one of said shaped sheet metal parts (32), and a second one of said flaps (46), belonging to a second one of said shaped metal parts (42), together form a bearing means for a connecting rod.

7. A piston according to claim 3, wherein a first one of said shaped sheet metal parts (32) has a size matching a surface area of said bottom and wherein a second one of said shaped sheet metal parts (42) has a size matching a surface area of said bottom, wherein said first shaped sheet metal part (32) has at least a first one of said flaps (36) stamped out of said first shaped sheet metal part (32) and said second shaped sheet metal part (42) has at least a second one of said flaps (46) stamped out of said second sheet metal part (42), wherein said first and second flaps (36, 46) are arranged such that said first flap (36) extends through an opening resulting from stamping and bending said second flap (46) into position, wherein said first and second flaps (36, 46) are attached to one another.

8. A piston according to claim 3, wherein a plurality of said flaps (4, 72, 96, 100) are provided at said bottom for supporting a plurality of connecting rods to achieve a uniform loading of said piston.

9. A piston according to claim 3, wherein at least one of said sheet metal parts (70) has a bent circumferential edge forming a groove (74) for receiving a piston ring 6.

10. A piston according to claim 3, wherein said piston body has an end face facing a combustion chamber and wherein said end face has a thermal insulation coating.

* * * * *